US006224987B1

(12) United States Patent
Yahagi

(10) Patent No.: US 6,224,987 B1
(45) Date of Patent: May 1, 2001

(54) CONDUCTIVE SUBSTRATE FOR ELECTROPHOTOCONDUCTOR

(75) Inventor: Hidetaka Yahagi, Nagano (JP)

(73) Assignee: Fuji Electric Co., Ltd. (JP)

( * ) Notice: Subject to any disclaimer, the term of this patent is extended or adjusted under 35 U.S.C. 154(b) by 0 days.

(21) Appl. No.: 09/328,532

(22) Filed: Jun. 9, 1999

(30) Foreign Application Priority Data

Jun. 17, 1998 (JP) ..... 10-169935

(51) Int. Cl.[7] ..... C22C 21/00

(52) U.S. Cl. ..... 428/472; 148/276; 148/277; 148/415; 148/437; 148/440; 148/523; 148/538; 148/549; 427/126.1; 427/126.3; 427/318; 427/402; 427/419.1; 427/419.2; 428/469; 428/699; 428/701

(58) Field of Search ..... 428/472, 469, 428/697, 699, 701, 702; 148/437, 440, 415, 276, 277, 523, 538, 549; 420/528, 543, 546; 427/126.1, 126.3, 318, 402, 419.1, 419.2

(56) References Cited

U.S. PATENT DOCUMENTS 4,039,355 * 8/1977 Takahashi et al. ..... 148/31.5
4,672,022 * 6/1987 Reiss et al. ..... 430/278
4,729,939 * 3/1988 Nishikawa et al. ..... 420/544
5,240,519 * 8/1993 Kamito et al. ..... 148/415
5,328,790 * 7/1994 Asano et al. ..... 430/65
5,843,247 * 12/1998 Fukagawa et al. ..... 148/415
5,875,375 * 2/1999 Ohmori et al. ..... 399/159

FOREIGN PATENT DOCUMENTS 4-172359 6/1992 (JP) .
10-188956 6/1998 (JP) .

* cited by examiner

*Primary Examiner*—Archene Turner
(74) *Attorney, Agent, or Firm*—Morrison Law Firm

(57) ABSTRACT

A conductive substrate of an electrophotographic photoconductor has magnesium suicide precipitated therein as an impurity compound. The conductive substrate has an aluminum oxide film of minimum thickness deviation, and an aluminum base which exhibits a light scattering effect. An electrophotographic photoconductor using such a conductive substrate suppresses interference fringes caused by the interference action of a semiconductor laser light. Furthermore, irregular printing density and the formation of black spots is eliminated. A method for making such a conductive substrate includes annealing an aluminum base doped with silicon and magnesium to precipitate out $Ms_2Si$, followed by anodizing a surface of the aluminum base to form an aluminum oxide film. A charge generation layer and a charge transport layer are formed on the aluminum oxide film to complete the electrophotographic photoconductor.

10 Claims, 1 Drawing Sheet

CONDUCTIVE SUBSTRATE FOR ELECTROPHOTOCONDUCTOR

BACKGROUND OF THE INVENTION

The present invention relates to a conductive substrate for an electrophotographic photoconductor. More specifically, the present invention relates to a conductive substrate for an electrophotographic photoconductor having an aluminum oxide film on its surface. The present invention further relates to a manufacturing method of a conductive substrate for an electrophotographic photoconductor.

Electrophotography has developed in the field of the photostatic copiers. Recently, electrophotography has been applied to laser printing and the like. Since electrophotography is far superior than conventional impact printing in image quality, speed, and stillness, it has come to be employed widely in many devices. The conventional photoconductor installed in these devices is made of a conductive substrate having a photoconductive layer formed thereon.

The conventional conductive substrate consists of a conductive base having an undercoating layer formed thereon. Aluminum is widely used for the conductive base. Organic substances are widely used for the photoconductive layer.

The undercoating layer is formed from coating a layer of plastic, such as polyamide, onto the conductive substrate. In the alternative, the undercoating layer is formed by anodizing an oxide film onto the conductive substrate. The latter is widely used in photoconductors of high reliability, since oxide films are advantageous under environments of high temperature and high humidity. A conductive base soaked in an electrolytic solution is anodized. An oxide film is then formed on the conductive base.

Generally, the film thickness of the oxide film formed on the conductive base is ruled by the current density and the passing duration of the current, so long as the anodic current concentration is not exceeded.

Recent anodizing methods of aluminum include adjusting the configuration and spacing of an opposing electrode. Further methods devise a wave form of the current which makes the electrolytic solution foam, improving the circulation of the electrolytic solution. Such a method enables uniform distribution of the current over the entire surface of the aluminum base anode. The uniform distribution of current controls the thickness deviation of the oxide film within the range of ±1 $\mu$m. This limit in the thickness deviation creates a photoconductor having excellent printing quality.

Referring to FIG. 2, a surface of a conductive aluminum base 2*a* of a conventional electrophotographic photoconductor is anodized to form an aluminum oxide film 3. Conductive substrate 1*a* for a photoconductor includes conductive aluminum base 2*a* and aluminum oxide film 3.

A charge generation layer 4*a* and a charge transport layer 4*b* are successively formed on a surface of conductive substrate 1*a* to give a photoconductive layer 4. Charge generation layer 4*a* absorbs light and generates free charges. Charge transport layer 4*b* receives and transports these free charges.

A semiconductor laser light having a wave length of 780 nm is widely used as a light source for a printer.

Referring to FIG. 3, the above-mentioned light, having a wavelength of 780 nm, is irradiated on a conventional electrophotographic photoconductor. Conductive substrate 1*a* has aluminum base 2*a* and aluminum oxide film 3.

Photoconductive layer 4 has charge generation layer 4*a* and charge transport layer 4*b* on conductive substrate 1*a*.

A part of the semiconductor laser light, having a wave length of 780 nm, incident to a photoconductor indicated by an arrow L, reaches aluminum oxide film 3 without being absorbed by charge generation layer 4*a*. The light partially penetrates aluminum oxide film 3. The penetrated light is reflected at the boundary of aluminum base 2*a* and aluminum oxide film 3 (arrow A). A portion of the light does not penetrate aluminum oxide film 3. This portion is reflected at the boundary of charge generation layer 4*a* and aluminum oxide film 3 (arrow B).

Reflected lights A and B have the same single wavelength and are coherent. Light B interferes with light A in photoconductive layer 4, resulting in the generation of interference fringes due to thickness variations. These interference fringes cause irregular printing density.

Japanese Laid-open Patent Publication No.6-317921 and Japanese Laid-open Patent Publication No.7-301935 disclose means to prevent irregular printing density by controlling the generation of interference fringes. These reports propose to anodize aluminum using a current of changing wave form, allowing the light to scatter in the oxide film.

When various improved manufacturing methods, such as those mentioned in Japanese Laid-open Patent Publication No.6-317921 and Japanese Laid-open Patent Publication No.7-301935, are used to obtain an uniform current density, there is obtained an aluminum oxide film with small thickness deviations. However, when semiconductor laser light is irradiated onto the photoconductor, interference fringes are generated due to small thickness variations by an interference action as described in FIG. 3.

On the other hand, an aluminum oxide film exhibiting the above-mentioned effect of light scattering in the oxide film results in increased thickness deviation. This increase in thickness deviation leads to photoconductors having variations in their characteristics.

OBJECTS AND SUMMARY OF THE INVENTION

It is an object of the present invention to provide a conductive substrate for an electrophotographic photoconductors which overcomes the foregoing problems.

It is a further object of the present invention to provide a method of manufacturing a conductive substrate for an electrophotographic photoconductors which overcomes the foregoing problems.

It is another object of the present invention to provide a conductive substrate for an electrophotographic photoconductor having an aluminum oxide film of minimum thickness deviation and an aluminum base which prevents the generation of interference fringes when semiconductor laser light is irradiated onto the electrophotographic photoconductor.

It is yet another object of the present invention to provide a method of manufacturing a conductive substrate for an electrophotographic photoconductor having an aluminum oxide film of minimum thickness deviation and an aluminum base which prevents the generation of interference fringes when semiconductor laser light is irradiated onto the electrophotographic photoconductor.

It is still a further object of the present invention to provide an electrophotographic photoconductor having a conductive substrate with an aluminum oxide film of minimum thickness deviation and an aluminum base which prevents the generation of interference fringes when semiconductor laser light is irradiated onto the electrophotographic photoconductor.

Briefly stated, the present invention provides a conductive substrate of an electrophotographic photoconductor having magnesium silicide precipitated therein as an impurity compound. The conductive substrate has an aluminum oxide film of minimum thickness deviation, and an aluminum base which exhibits a light scattering effect. An electrophotographic photoconductor using such a conductive substrate suppresses interference fringes caused by the interference action of a semiconductor laser light. Furthermore, irregular printing density and the formation of black spots is eliminated. A method for making such a conductive substrate includes annealing an aluminum base doped with silicon and magnesium to precipitate out $Ms_2Si$, followed by anodizing a surface of the aluminum base to form an aluminum oxide film.

According to an embodiment of the present invention, there is provided a conductive substrate for an electrophotographic photoconductor comprising: an aluminum base; an aluminum oxide film on the aluminum base; and the aluminum base having magnesium silicide, $Mg_2Si$, precipitated therein.

According to a method of the present in vention, there is provided a method of making a conductive substrate for an electrophotographic photoconductor comprising: casting aluminum having silicon and magnesium doped therein; forming an aluminum base from the aluminum; annealing the aluminum base; forming an intermetallic compound of $Mg_2Si$ in the aluminum base; and forming an aluminum oxide film on the aluminum base.

According to a further embodiment of the present invention, there is provided an electrophotographic photoconductor comprising: a conductive substrate; an organic photoconductive layer on a surface of the conductive substrate; the conductive substrate having an aluminum base and an aluminum oxide film on the aluminum base; and the aluminum base having magnesium silicide, $Mg_2Si$, precipitated therein.

The above objects are achieved by the present invention in which a conductive substrate for an electrophotographic photoconductor comprises an aluminum base and an aluminum oxide film formed thereon. The aluminum base contains magnesium silicide, which is an intermetallic compound precipitated in aluminum.

The aluminum base is effectively manufactured with aluminum doped with silicon and magnesium, as impurity elements, by a process of the present invention. This process casting the aluminum, extruding the aluminum and annealling to precipitate the magnesium silicide of the intermetallic compound thereon. Next, the aluminum oxide film is formed by anodizing the surface of the aluminum base.

The content of the impurity elements ire preferably in a range from about 0.1 to 1.0 weight percent of silicon, and 0.2 to 0.9 weight percent of magnesium. Preferably, the annealing process is performed for about 1.5 to 2.5 hours. More preferably, the annealing process is performed at a temperature range from about 280° C. to 320° C.

The above, and other objects, features and advantages of the present invention will become apparent from the following description read in conjunction with the accompanying drawings, in which like reference numerals designate the same elements.

DETAILED DESCRIPTION OF THE INVENTION

The present invention is characterized by a conductive substrate for an electrophotographic photoconductor having an aluminum base containing precipitated magnesium silicide of an intermetallic compound and an aluminum oxide film formed anodically on the aluminum base.

The aluminum base is manufactured with aluminum doped with silicon and magnesium, as impurity elements, to precipitate the magnesium silicide of the intermetallic compound therein. Said aluminum is cast, extruded to make raw tubing, and is annealed, for instance, at 300 degrees centigrade for two hours. The tubing is cut in a fixed length, degreased, and washed.

Figure 1:
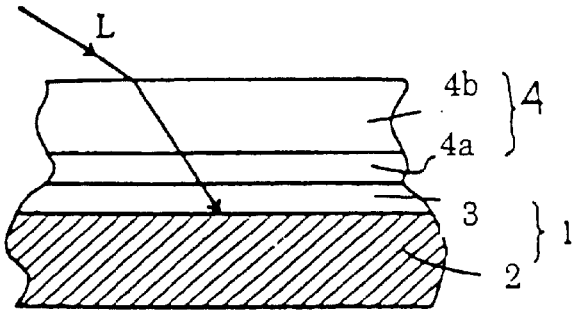
FIG. 1 is a partial cross section of a photoconductor of the present invention.
Figure 2:
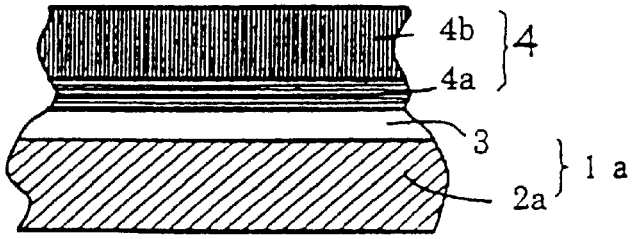
Fig. 2 PRIOR ART
FIG. 2 is a partial cross section of a conventional photoconductor having a function-separated multi-layered construction.
Figure 3:
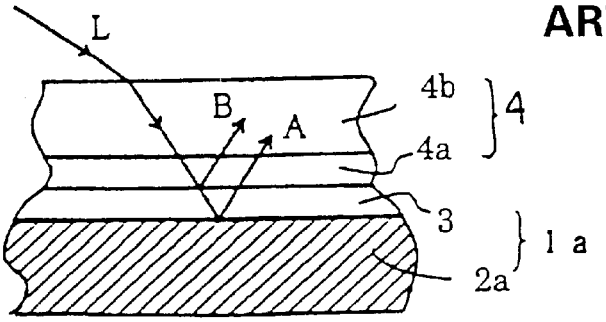
Fig. 3 PRIOR ART
FIG. 3 is a partial cross section of a convention photoconductor being irradiated with semiconductor laser light.

Referring to FIG. 1, an aluminum base 2 is made by adjusting the content of silicon and magnesium in aluminum. A suitable amount of the intermetallic compound magnesium silicide precipitates in aluminum base 2.

An aluminum oxide film 3 is formed by anodizing a surface of aluminum base 2. Conductive substrate 1 for the photoconductor is made by the combination of aluminum base 2 having aluminum oxide film 3 formed thereon.

A charge generation layer 4*a* and a charge transport layer 4*b* are formed on conductive substrate 1 to form a conventional photoconductive layer 4, producing an electrophotographic photoconductor of the present invention.

Aluminum base 2 of conductive substrate 1 is made on the basis of experimental results as described in the following paragraphs.

The impurity elements are doped in aluminum base 2 in an amount from about 0.10 to 1.00 weight percent with regard to silicon (Si) and about 0.20 to 0.90 weight percent with regard to magnesium (Mg) to precipitate the intermetallic compound magnesium silicide in aluminum base 2. Preferably, magnesium is doped in aluminum base 2 in an amount from 0.30 to 0.82 weight percent with respect to the weight of aluminum base 2.

Preferably, anodizing is performed in an electrolytic solution having an aluminum sulfate content from about 1–10 ($g/dm^3$) and a sulfuric acid concentration of about 15% at the mean current density of, for example, 1 ($A/dm^2$) for 24 minutes.

An electrophotographic photoconductor using conductive substrate 1 prepared by the above-mentioned method is manufactured by the following process. First, conductive substrate 1 is washed with an alkaline cleaning agent and dried. Next, a coating liquid is applied on a surface of conductive substrate 1, forming a charge generation layer 4*a*. The coating liquid for charge generation layer 4*a* is prepared by dispersing, for example, four parts of metal-free phthalocyanine pigments and six parts of a vinyl chloride-vinyl acetate copolymer in tetrahydrofuran as a solvent.

Another coating, liquid is applied on charge generation layer 4*a*, forming charge transport layer 4*b*. The coating, liquid for charge tran-sport layer 4*b* is prepared by mixing, for instance, a hydrazone conducting substance and a polycarbonate resin in methylene chloride as a solvent. The process results in the formation of the electrophotographic photoconductor as shown in FIG. 1.

Semiconductor laser light, having a wave length of 780 nm, as indicated by arrow L, is irradiated onto the electrophotographic photoconductor. Light, which penetrates photoconductive layer 4, is scattered in the neighborhood of the boundary of aluminum base 2 and aluminum oxide film 3. This scattering of the penetrating light is caused by a scattering effect of the interrelate compound generated by the addition of the impurity elements, resulting in substantially eliminating the interference effects which are present in the electrophotographic photoconductors of the prior art.

Thus, the generation of interference fringes and an irregular printing density is suppressed, resulting in an enhanced image quality of the photoconductor.

EXAMPLE 1

Silicon and magnesium was added in an amount of 0.10 weight percent and 0.30 weight percent, respectively, in aluminum. Aluminum doped with the impurities was cast, extruded to make tubing, and annealed at a temperature of 300° C. for two hours to precipitate the intermetallic compound magnesium silicide.

Tubing having an outer diameter of 30 mm and an internal diameter of 27 mm was cut to a length of 320 mm, degreased, and washed to make an aluminum base. The resulting aluminum base was soaked in an electrolytic solution, and anodized at a mean current density of 1 ($A/dm^2$) for 24 minutes to give a layer of aluminum oxide thereon.

A photoconductive layer was then formed on the surface of the conductive substrate formed above to give an electrophotographic photoconductor.

EXAMPLE 2

The electrophotographic photoconductor of Example 2 was made according to the method of Example 1, except that silicon in an amount of 0.10 weight percent and magnesium in an amount of 0.82 weight percent was added in aluminum to form the electrophotographic photoconductor of Example 2.

EXAMPLE 3

The electrophotographic photoconductor of Example 3 was made according to the method of Example 1, except that silicon in an amount of 1.00 weight percent and magnesium in an amount of 0.30 weight percent was added in aluminum to form the electrophotographic photoconductor of Example 3.

EXAMPLE 4

The electrophotographic photoconductor of Example 4 was made according to the method of Example 1, except that silicon in an amount of 1.00 weight percent and magnesium in an amount of 0.82 weight percent was added in aluminum to form the electrophotographic photoconductor of Example 4.

Comparative Example 1

The electrophotographic photoconductor of Comparative Example 1 was made according to the method of Example 1, except that silicon in an amount of 0.09 weight percent and magnesium in an amount of 0.30 weight percent was added in aluminum to form the electrophotographic photoconductor of Comparative Example 1.

Comparative Example 2

The electrophotographic photoconductor of Comparative Example 2 was made according to the method of Example 1, except that silicon in an amount of 0.09 weight percent and magnesium in an amount of 0.82 weight percent was added in aluminum to form the electrophotographic photoconductor of Comparative Example 2.

Comparative Example 3

The electrophotographic photoconductor of Comparative Example 3 was made according to the method of Example 1, except that silicon in an amount of 0.10 weight percent and magnesium in an amount of 0.15 weight percent was added in aluminum to form the electrophotographic photoconductor of Comparative Example 3.

Comparative Example 4

The electrophotographic photoconductor of Comparative Example 4 was made according to the method of Example 1, except that silicon in an amount of 1.00 weight percent and magnesium in an amount of 0.15 weight percent was added in aluminum to form the electrophotographic photoconductor of Comparative Example 4.

Comparative Example 5

The electrophotographic photoconductor of Comparative Example 5 was made according to the method of Example 1, except that silicon in an amount of 0.10 weight percent and magnesium in an amount of 1.01 weight percent was added in aluminum to form the electrophotographic photoconductor of Comparative Example 5.

Comparative Example 6

The electrophotographic photoconductor of Comparative Example 6 was made according to the method of Example 1, except that silicon in an amount of 1.00 weight percent and magnesium in an amount of 1.01 weight percent was added in aluminum to form the electrophotographic photoconductor of Comparative Example 6.

Comparative Example 7

The electrophotographic photoconductor of Comparative Example 7 was made according to the method of Example 1, except that silicon in an amount of 1.21 weight percent and magnesium in an amount of 0.30 weight percent was added in aluminum to form the electrophotographic photoconductor of Comparative Example 7.

Comparative Example 8

The electrophotographic photoconductor of Comparative Example 8 was made according to the method of Example 1, except that silicon in an amount of 1.21 weight percent and magnesium in an amount of 0.82 weight percent was added in aluminum to form the electrophotographic photoconductor of Comparative Example 8.

Comparative Example 9

The electrophotographic photoconductor of Comparative Example 9 was made according to the method of Example 1, except that silicon in an amount of 0.10 weight percent and magnesium in an amount of 0.30 weight percent was added in aluminum, and annealling was omitted to suppress the precipitation of the intermetallic compound magnesium silicide to form the electrophotographic photoconductor of Comparative Example 9.

Comparative Example 10

The electrophotographic photoconductor of Comparative Example 10 was made according to the method of Example 1, except that silicon in an amount of 0.10 weight percent and magnesium in an amount of 0.82 weight percent was added in aluminum, and annealing was omitted to suppress the precipitation of the intermetallic compound magnesium silicide to form the electrophotographic photoconductor of Comparative Example 10.

Comparative Example 11

The electrophotographic photoconductor of Comparative Example 11 was made according to the method of Example 1, except that silicon in an amount of 1.00 weight percent and magnesium in an amount of 0.30 weight percent was added in aluminum, and annealing was omitted to suppress the precipitation of the intermetallic compound magnesium silicide to form the electrophotographic photoconductor of Comparative Example 11.

Comparative Example 12

The electrophotographic photoconductor of Comparative Example 12 was made according to the method of Example 1, except that silicon in an amount of 1.00 weight percent and magnesium in an amount of 0.82 weight percent was added in aluminum, and annealing was omitted to suppress the precipitation of the intermetallic compound magnesium silicide to form the electrophotographic photoconductor of Comparative Example 12.

Comparative Example 13

The electrophotographic photoconductor of Comparative Example 13 was made according to the method of Example 1, except that silicon in an amount of 0.60 weight percent and magnesium in an amount of 0.52 weight percent was added in aluminum, and annealing was omitted to suppress the precipitation of the intermetallic compound magnesium silicide to form the electrophotographic photoconductor of Comparative Example 13.

Twenty electrophotographic photoconductors for each of examples 1–4 and comparative examples 1–13 were prepared and installed in a laser printer having a light source emitting a semiconductor laser light with a wavelength of 780 nm.

Printing evaluation was conducted as to the presence or absence of image defects, such as black spot, and the generation of the interference fringes. The results of this evaluation are shown in Table 1.

TABLE 1

| | Aluminum Base | | | |
|---|---|---|---|---|
| | Si Content (wt. %) | Mg Content (wt. %) | Annealing | Evaluation |
| Example 1 | 0.10 | 0.30 | Performed | no I.F., no B.S. |
| Example 2 | 0.10 | 0.82 | Performed | no I.F., no B.S. |
| Example 3 | 1.00 | 0.30 | Performed | no I.F., no B.S. |
| Example 4 | 1.00 | 0.82 | Performed | no I.F., no B.S. |
| Comp. Ex. 1 | 0.09 | 0.30 | Performed | I.F. present |
| Comp. Ex. 2 | 0.09 | 0.82 | Performed | I.F. present |
| Comp. Ex. 3 | 0.10 | 0.15 | Performed | I.F. present |
| Comp. Ex. 4 | 1.00 | 0.15 | Performed | I.F. present |
| Comp. Ex. 5 | 0.10 | 1.01 | Performed | B.S. present |
| Comp. Ex. 6 | 1.00 | 1.01 | Performed | B.S. present |
| Comp. Ex. 7 | 1.21 | 0.30 | Performed | B.S. present |
| Comp. Ex. 8 | 1.21 | 0.82 | Performed | B.S. present |
| Comp. Ex. 9 | 0.10 | 0.30 | Omitted | I.F. present |
| Comp. Ex. 10 | 0.10 | 0.82 | Omitted | I.F. present |
| Comp. Ex. 11 | 1.00 | 0.30 | Omitted | I.F. present |

TABLE 1-continued

| | Aluminum Base | | | |
|---|---|---|---|---|
| | Si Content (wt. %) | Mg Content (wt. %) | Annealing | Evaluation |
| Comp. Ex. 12 | 1.00 | 0.82 | Omitted | I.F. present |
| Comp. Ex. 13 | 0.60 | 0.53 | Omitted | I.F. present |

In Table 1, Comp.Ex. denotes Comparative Example, I.F. implies Interference Fringes, B.S. is Black Spot, and Annealing signifies the precipitation of the intermetallic compound.

The electrophotographic photoconductors referred to in Examples 1–4 employ an aluminum base formed from aluminum doped with silicon and magnesium in an amount from 0.10–1.00 weight percent, and 0.30 to 0.82 weight percent, respectively. The electrophotographic photoconductors of Examples 1–4 are further annealed to precipitate the magnesium silicide of the intermetallic compound.

As shown in Table 1, for the electrophotographic photoconductors of the present invention, there were neither an irregular printing density due to the generation of interference fringes nor image defects such as black spot, etc. Furthermore, the printing quality from the electrophotographic photoconductors of Examples 1–4 was excellent.

The electrophotographic photoconcluctors referred to in Comparative Examples 1–4 use an aluminum base made from aluminum doped with silicon in an amount less than 0.10 weight percent, or magnesium less than 0.20 weight percent. In Comparative Examples 1–4, the photoconductors are formed by a process including an annealing step, as in Example 1–4.

The electrophotographic photoconductors of Comparative Examples 1–4 generated interference fringes, due to a small light scattering effect.

Electrophotographic photoconductors referred to in Comparative Examples 5–8 have an aluminum base made from aluminum doped with silicon in an amount more than 1.0 weight percent, or magnesium more than 0.9 weight percent. In Comparative Examples 5–8, the photoconductors are formed by a process including an annealing step, as in Example 1–4.

The electrophotographic photoconductors of Comparative Examples 5–8 generated black spots due to the overgrowth of the intermetallic compound.

Electrophotographic photoconductors referred to in Comparative Examples 9–13 comprise an aluminum base made from aluminum doped with silicon in an amount from 0.10 to 1.00 weight percent and magnesium in an amount from 0.30 to 0.82 weight percent. However, in these Examples, annealing for suppressing the precipitation of the intermetallic compound was not conducted. Since all electrophotographic photoconductors of Comparative Examples 9–13 generated interference fringes, it is understood that there is no desirable range of impurity content that can be specified when the annealing step is omitted.

When a semiconductor laser light, having a wavelength of 780 nm, is incident to an electrophotographic photoconductor using the conductive substrate of the present invention, the light penetrates the photoconductive layer. The light is then scattered by the scattering effect of the intermetallic compound produced by the addition of silicon and magnesium in the neighborhood of the boundary of the aluminum base and the aluminum oxide film. This scattering effect causes the interference action of the light to disappear. The scattering effect suppresses the generation of interference fringes, preventing an irregular printing density, thus providing an electrophotographic photoconductor with an improved image quality.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A conductive substrate for an electrophotographic photoconductor comprising:

a base containing aluminum with magnesium silicide, $Mg_2Si$, precipitated therein; and an aluminum oxide film on said base.

2. A conductive substrate for an electrophotographic photoconductor according to claim 1, wherein:

said $Mg_2Si$ is precipitated by annealing said base; and said aluminum base contains from about 0.10 to about 1.00 weight percent silicon and from about 0.20 to about 0.90 weight percent magnesium.

3. An electrophotographic photoconductor comprising:

the conductive substrate of claim 1; and an organic photoconductive layer on a surface of said conductive substrate.

4. An electrophotographic photoconductor according to claim 3, wherein said $Mg_2Si$ is present in said base up to about 1.4 weight percent relative to said base.

5. A method of making the conductive substrate of claim 1 comprising:

casting aluminum having silicon and magnesium doped therein;

forming a base from said aluminum;

annealing said base;

forming an intermetallic compound of $Mg_2Si$ in said base; and forming an aluminum oxide film on said base.

6. A method of making a conductive substrate according to claim 5, wherein said intermetallic compound of $Mg_2Si$ is formed by said annealing of said base.

7. A method of making a conductive substrate according to claim 5, wherein forming said aluminum oxide film includes anodizing a surface of said base.

8. A method of making a conductive substrate according to claim 5, wherein forming said intermetallic compound includes precipitation of said intermetallic compound in said base.

9. A method of making a conductive substrate according to claim 5, wherein said annealing step is conducted at a temperature from about 280 to 320° C. for about 1.5 to 2.5 hours.

10. A method of making a conductive substrate according to claim 5, further comprising:

doping said silicon in a range from about 0.10 to 1.00 weight percent relative to said aluminum; and doping said magnesium in a range from about 0.20 to 0.90 weight percent relative to said aluminum.

* * * * *